US008307495B1

(12) United States Patent
Berkseth

(10) Patent No.: US 8,307,495 B1
(45) Date of Patent: Nov. 13, 2012

(54) DOOR CYLINDER

(75) Inventor: John K. Berkseth, Rice Lake, MN (US)

(73) Assignee: Hardware Specialties, Inc., Spooner, WI (US)

( * ) Notice: Subject to any disclaimer, the term of this patent is extended or adjusted under 35 U.S.C. 154(b) by 437 days.

(21) Appl. No.: 12/708,248

(22) Filed: Feb. 18, 2010

(51) Int. Cl.
*E05F 3/02* (2006.01)

(52) U.S. Cl. ..... 16/66; 16/84; 16/72

(58) Field of Classification Search ..... 16/49, 66, 16/80, 65, 70, 57, 51, DIG. 17, 71, 56, 53, 16/82, 83, 84, 85, DIG. 9, 72, 75, 76
See application file for complete search history.

(56) References Cited

U.S. PATENT DOCUMENTS

| | | | | | |
|---|---|---|---|---|---|
| 2,453,831 | A | * | 11/1948 | Croskey et al. | 16/65 |
| 2,732,920 | A | * | 1/1956 | Newton | 16/66 |
| 2,843,226 | A | | 7/1958 | Nordmark | |
| 2,920,338 | A | * | 1/1960 | Falk | 16/66 |
| 3,026,104 | A | * | 3/1962 | Gerth et al. | 16/66 |
| 3,032,806 | A | * | 5/1962 | Mallory | 16/66 |
| 3,090,988 | A | | 5/1963 | Truhon | |
| 3,105,264 | A | | 10/1963 | Truhon | |
| 3,162,889 | A | | 12/1964 | Runnels | |
| 3,566,435 | A | * | 3/1971 | Nakamura | 16/66 |
| 4,194,264 | A | | 3/1980 | Stoffregen | |
| 4,286,412 | A | | 9/1981 | Stevens | |
| 4,382,311 | A | | 5/1983 | Watts | |
| 4,545,322 | A | | 10/1985 | Yang | |
| 4,707,882 | A | | 11/1987 | Watts | |
| 4,722,116 | A | | 2/1988 | Erickson | |
| 4,777,698 | A | | 10/1988 | Lord | |
| 4,815,163 | A | | 3/1989 | Simmons | |
| 4,920,609 | A | | 5/1990 | Lin | |
| 5,048,150 | A | | 9/1991 | Guerin | |
| 5,157,806 | A | * | 10/1992 | Wartian | 16/66 |
| 5,529,148 | A | | 6/1996 | O'Leary | |
| 5,592,780 | A | | 1/1997 | Checkovich | |
| 5,630,248 | A | | 5/1997 | Luca | |
| 5,659,925 | A | | 8/1997 | Patterson | |
| 5,829,097 | A | | 11/1998 | Toledo | |
| 5,832,562 | A | | 11/1998 | Luca | |
| 5,842,255 | A | | 12/1998 | Luca | |
| 5,845,360 | A | * | 12/1998 | Lantzy | 16/66 |
| 5,953,789 | A | * | 9/1999 | Alonso | 16/66 |
| 6,032,331 | A | * | 3/2000 | Alonso | 16/66 |
| 6,202,253 | B1 | | 3/2001 | Green | |
| 6,317,922 | B1 | | 11/2001 | Kondratuk | |
| 6,615,449 | B1 | | 9/2003 | Alvarez | |
| 6,634,058 | B1 | | 10/2003 | Lin | |
| 6,640,387 | B2 | * | 11/2003 | Alonso | 16/72 |
| 6,904,643 | B2 | * | 6/2005 | Duffy | 16/82 |
| 6,938,302 | B2 | * | 9/2005 | Lin | 16/72 |

(Continued)

*Primary Examiner* — Jeffrey O Brien
(74) *Attorney, Agent, or Firm* — Moss & Barnett

(57) ABSTRACT

The present invention is a door closer for controlling the rate a door is closed. The door closer includes a tubular cylinder closed at a first end. Slidably mounted within the tubular housing is a rod assembly that includes a piston at a first end. As the rod assembly is moved through the cylinder, air is drawn into and expelled from the cylinder. A hold open bracket is mounted on the rod assembly for locking the position of the rod assembly with respect to the cylinder. A pair of springs is mounted on the rod, one on each side of the hold open bracket, to maintain the hold open bracket in a neutral position in normal operation. A cover is slidably mounted over the second end of the cylinder to move the hold open bracket to a locked position.

18 Claims, 13 Drawing Sheets

U.S. PATENT DOCUMENTS

| | | | | |
|---|---|---|---|---|
| 6,976,288 | B1 * | 12/2005 | Luca | 16/66 |
| 7,111,359 | B1 * | 9/2006 | Luca | 16/66 |
| 7,134,168 | B1 | 11/2006 | Qing | |
| 2002/0026684 | A1 * | 3/2002 | Seiferd | 16/84 |
| 2003/0110589 | A1 * | 6/2003 | Lin | 16/66 |
| 2003/0126716 | A1 | 7/2003 | Lin | |
| 2003/0226235 | A1 * | 12/2003 | Hodson | 16/66 |
| 2004/0148733 | A1 * | 8/2004 | Wartian | 16/66 |
| 2005/0198773 | A1 | 9/2005 | Alonso | |
| 2007/0271730 | A1 * | 11/2007 | Alonso | 16/66 |

* cited by examiner (SECTION A-A)

SECTION B-B (DETAIL D)

(SECTION A-A)

(SECTION B-B )

(DETAIL C)

(SECTION A-A)

(SECTION B-B)

(SECTION A-A )

(SECTION A-A )

DOOR CYLINDER

FIELD OF THE INVENTION

The present invention relates to a door control cylinder for controlling the closure of a door.

BACKGROUND OF THE INVENTION

Many door cylinders or "closers" exist for controlling the closure of doors, particularly screen doors. These closers are generally designed to control the rate a door is opened and closed and many door closers are designed to lock a door in a selected open position.

A well known prior art door closer utilizes a cylinder connected at a first end to a door (or a door frame) with a spring loaded rod assembly extending from a second end. The second end of the cylinder is pivotally connected to the door frame (or door if the first end of the cylinder is connected to the door frame). Air enters the cylinder as the rod assembly is extended and the door is opened, and escapes through an adjustable orifice on the first end of the cylinder as the door is spring closed, thereby checking the rate of speed at which the door is spring closed with an air cushion action. The door can be held open by a hold open bracket carried on the rod. In normal operation, the hold open bracket is oriented in a "neutral" position to allow the rod assembly to retract into the cylinder when the door closes. When it is desired to keep the door partially or fully open, the hold open bracket is misaligned with the rod adjacent the second end of the cylinder to cause the rod and hold open bracket to bind against the cylinder (the "locked position"), keeping the rod assembly from retracting into the cylinder and effectively locking the door in an open position.

The hold open brackets are not always successful at preventing the rod assembly from retracting into the cylinder or allowing the rod assembly to be extended from the cylinder. Setting and/or maintaining the proper orientation of the hold open bracket is frequently the cause of these difficulties. Some prior art door closers have utilized a single spring to help bias the hold open bracket in a neutral or locked position, but these arrangements have not always proved successful.

Another problem with the prior art is that once the hold open bracket is oriented in its locked position, it is sometimes difficult to release the hold open bracket to permit the rod assembly to be retracted into the cylinder so the door can be closed. When the rod assembly is fully extended and the door closer is in the locked position, it is often particularly difficult to unlock the rod assembly.

Yet another issue with prior art door closers is that hold open brackets can also become greasy and dirty over time and it is undesirable to have to handle the hold open bracket. Further, handling of the locking mechanism can result in injury, such as pinched fingers.

Many prior art door closers rely on some retraction of the rod assemblies into the closer tube before the hold open bracket will fully engage the closer tube and lock the position of the rod assembly with respect to the closer tube. When the rod assembly retracts into the closer tube, it causes the door to swing towards its closed position. This reduces the width of the door opening. Further adjustments may be required to obtain the desired door opening width. In the case of a door that is being locked in a fully open position, this retraction of the rod assembly results in a loss of some of the available door opening width. This can be frustrating for the user if a greater door width is required, such as for moving large furniture through the door opening. Thus, there is a need for a door closer that will retain the door in its desired position when the hold open bracket is actuated. There is also a need for a door closer that will maintain a door in its fully open position without loss of door opening width due to retraction of the rod assembly back into the closer tube to actuate the hold open bracket.

Many modifications and improvements have been made in the art in an attempt to overcome these problems. For instance, mechanical levers have been utilized to provide better control of door closer locking washers or locking mechanisms and to avoid direct contact with greasy locking washers. U.S. Pat. No. 3,105,264 to J. A. Truhon discloses the use of a lever latch assisted by a single spring offset from, but generally parallel to, the longitudinal axis of the piston. U.S. Pat. Nos. 3,162,889 to R. J. Runnels and 6,634,058 to Lin disclose the use of a single release spring mounted over the piston rod, between the cylinder and the holding clip or retainer plate, to facilitate release of the holding clip or retainer plate. These devices are not effective to prevent the locking member and piston rod from getting dirty or protecting the user of the door control.

U.S. Publication No. 2003/0126716 in favor of Lin and U.S. Pat. No. 7,134,168 to Qing disclose the use of a cover, a lever and a single spring to facilitate setting of the washer and protection of the washer and user. These arrangements arguably may protect the user of the washer and prevent it from getting dirty. However, Qing provides a complicated mechanism for aligning the washer and Lin simply addresses leveraging of the locking washer by mounting an additional part on the piston that can also bind the operation of the piston.

U.S. Pat. No. 6,317,922 to Kondratuk discloses rotation of an end cap covering the exposed end of the piston rod to rotate a washer between a locked position and an unlocked position. A leg of the washer is moved into engagement with a raised surface of the cylinder end to lock the position of the piston rod and the same leg of the washer is moved into alignment with an inclined surface of the cylinder end to permit the piston to be extended from and refracted into the cylinder.

U.S. Pat. No. 6,615,449 to Alvarez discloses the use of a pair of concentric cups or caps positioned over the extended portion of the rod to move a flange member into a locked position. A flange member and a single spring are mounted on a rod in sliding relation, with the spring positioned on the side of the flange member adjacent the door control cylinder. The spring is intended to keep the flange member in a neutral position so that the rod can be retracted into the control cylinder. An inner cup is secured to an end of the control cylinder over the flange member and spring in sliding relation with the rod. The rod partially extends through an opening in the inner cup and is in sliding relation with the inner cup. An engagement pin is spring mounted on the inner cup to engage the flange member and move it to the locked position. The outer cup is mounted over the inner cup in sliding relation for movement towards and away from the inner cup. Upon movement of the outer cup towards the inner cup, the engagement pin is moved into engagement with the flange member to lock the piston in place with respect to the cylinder, preventing the rod from retracting into the control cylinder.

Applicant believes that the mechanisms described above and other prior art door controllers continue to experience problems of binding between the hold open bracket and the rod, maintaining the rod assembly in the locked position and unlocking the rod assembly. There continues to be a need for a simple way to operate door controller with an easy to set and release hold open bracket. The hold open bracket of the present invention is covered to protect the hold open bracket and to prevent injury to the operator and is easy to lock and unlock. The present invention is believed to address the shortcomings of the prior art and constitutes an improvement over the background technology.

SUMMARY OF THE INVENTION

The present invention is a releasable locking door controller. One advantage of the present invention is a dual spring arrangement for maintaining the hold open bracket in its neutral position until acted upon by a lock actuator carried in a cover mounted over the rod end of the cylinder. Another advantage is a spring mounted release pin designed to prevent the rod assembly from being inextricably locked in its extended position. Yet another advantage of the present invention is its ease of use—a slight movement of the cover locks the position of the rod assembly; the rod assembly is unlocked by a slight further opening of the door. These recited advantages and features of the present invention are not exclusive.

The features, benefits and objects of this invention will become clear to those skilled in the art by reference to the following description, claims and drawings.

BRIEF DESCRIPTION OF THE DRAWINGS

Referring now to the drawings, wherein like reference numerals indicate corresponding structure through the several views.

DETAILED DESCRIPTION OF THE PREFERRED EMBODIMENT

Even though numerous characteristics and advantages of the present invention have been set forth in the following description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

Figure 1:
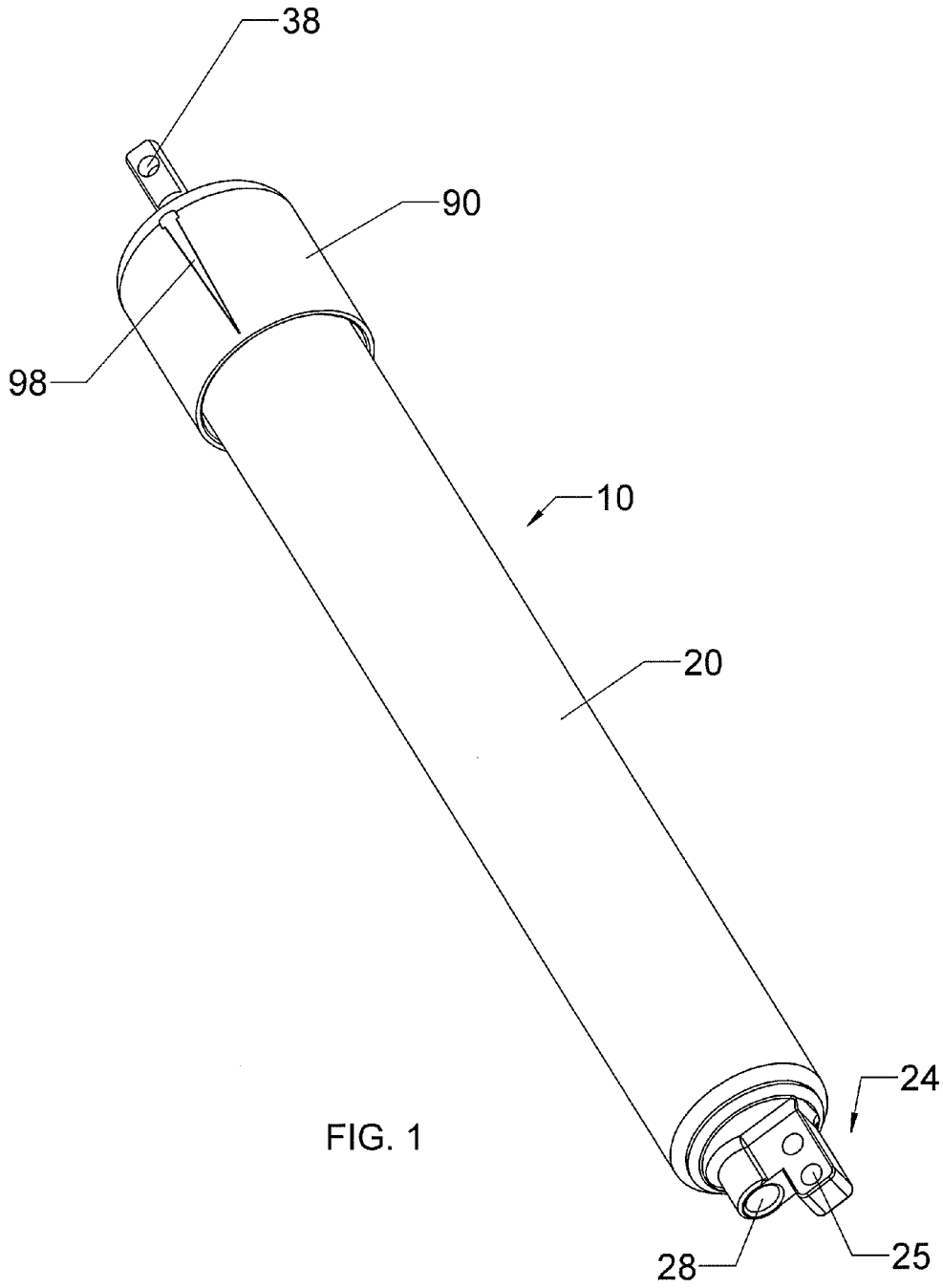
FIG. 1 is a perspective view of the door cylinder of the present invention with the rod retracted into the cylinder.
Figure 2:
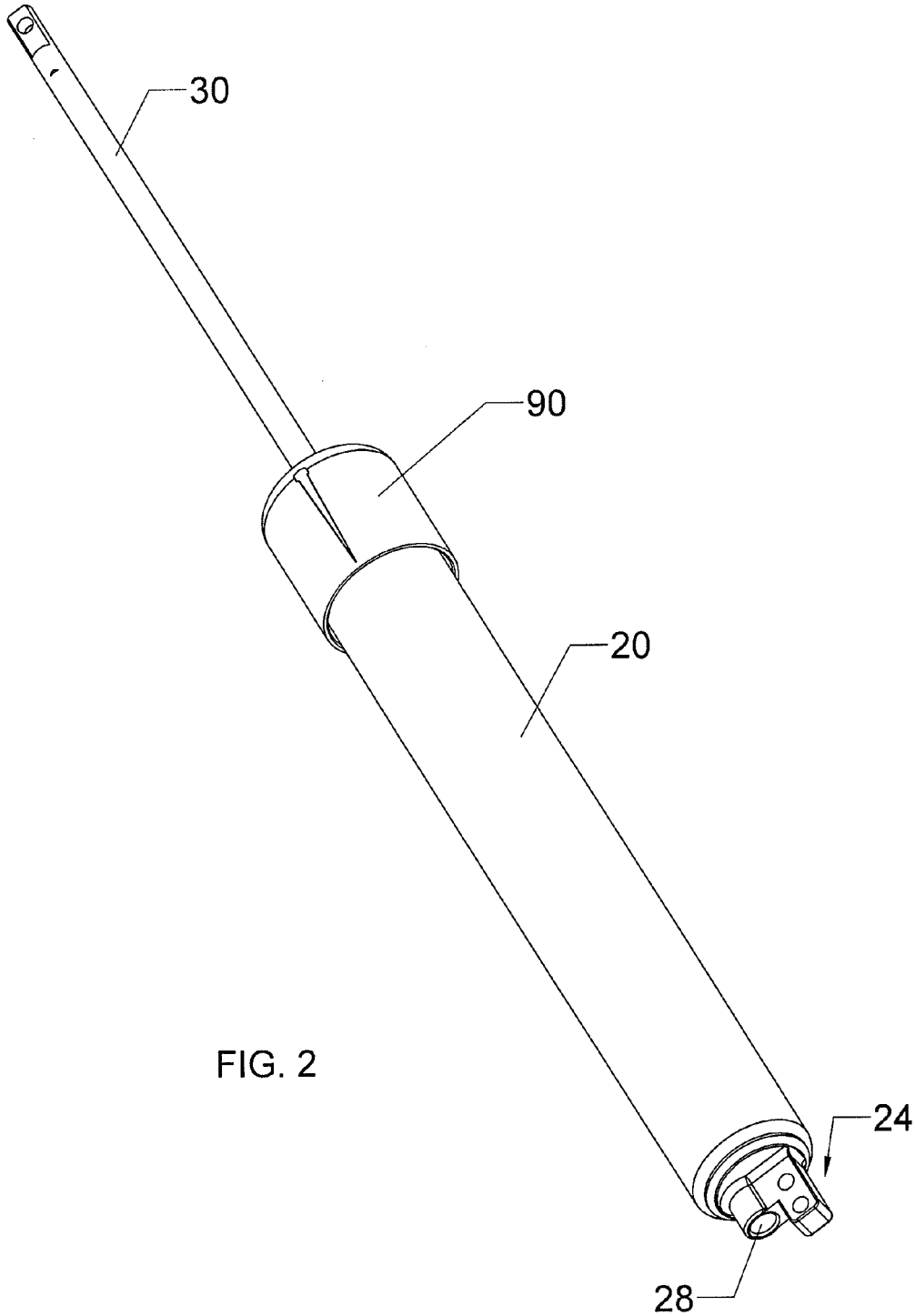
FIG. 2 is a perspective view of the door cylinder of the present invention with the rod extended out from the cylinder.
Figure 3:
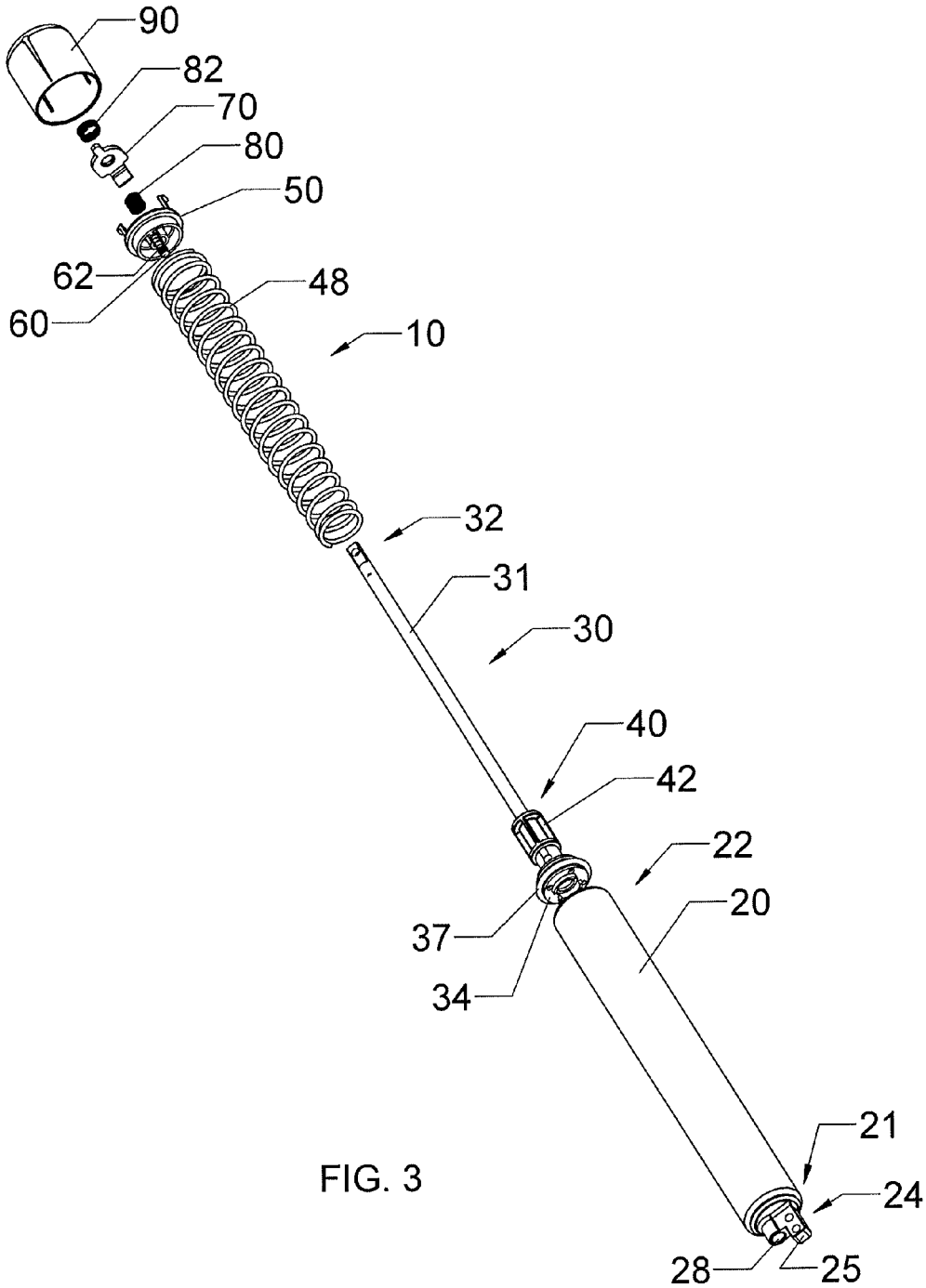
FIG. 3 is a perspective exploded view of the door cylinder of the present invention illustrating the various components of the door cylinder.
Figure 4A:
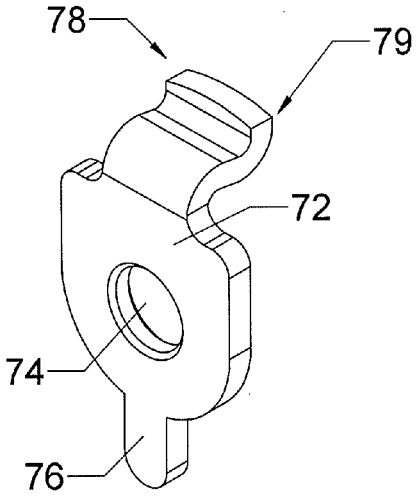
FIG. 4A is a perspective view of the hold open bracket of the present invention.
Figure 4B:
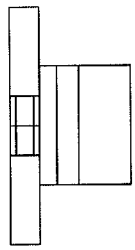
FIG. 4B is a top view of the hold open bracket of the present invention.
Figure 4C:
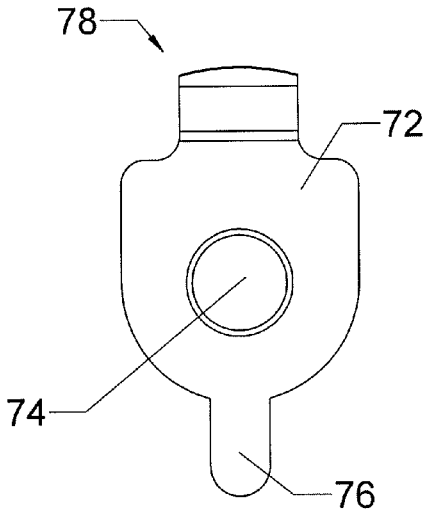
FIG. 4C is a front view of the hold open bracket of the present invention.
Figure 4D:
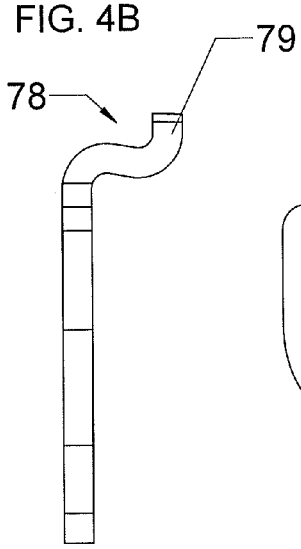
FIG. 4D a side view of the hold open bracket of the present invention.
Figure 4E:
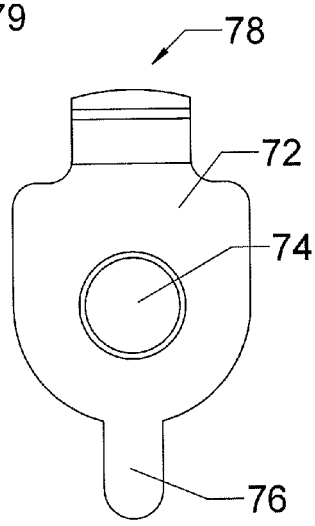
FIG. 4E is a back view, opposite that of FIG. 4C, of the hold open bracket of the present invention.

Referring to FIG. 3, the door cylinder 10 of the closer or door control of the present invention includes a cylindrical closer tube (housing) 20, a rod assembly 30, a spring 48, a rod end cap 50, a hold open bracket 70 and a cover 90.

The closer tube 20 is connected to a door or door frame by a first end 21. The spring 48 and rod assembly 30 are mounted in the closer tube 20 and held in place by rod end cap 50.

The rod assembly 30 includes a generally cylindrical rod 31 and a piston 34. A first end 32 of the rod 31 extends through an opening 53 in the rod end cap 50. Mounted on the first end 32 of rod 31 is a first bracket spring 80, followed by the hold open bracket 70 and a second bracket spring 82 and cover 90. The first end 32 of the rod 31 is connected to either a door frame or a door, opposite that to which the first end 21 of closer tube 20 is connected.

Like many known closers, air enters the cylinder freely as the door is opened, and escapes through an adjustable valve 28 as the door is spring closed, thus checking the rate of speed at which the door is spring closed with an air cushion action. The door can be held open by hold open bracket 70. In normal operation, the hold open bracket 70 is held in a "neutral" position by first bracket spring 80 and second bracket spring 82 permitting the rod 31 to retract into closer tube 20 when the door closes. When it is desired to keep the door partially or fully open, the hold open bracket 70 is misaligned with the rod 31 to cause the rod 31 and hold open bracket 70 to bind against a second end 22 of closer tube 20, keeping the rod assembly 30 from retracting into the closer tube 20, locking the door in a selected open position.

Without limitation, advantages of the present invention include a dual spring arrangement for maintaining the hold open bracket 70 in its neutral position until acted upon by a lock actuator carried in cover 90, a spring mounted release pin 60 spring mounted on the rod end cap 50 to prevent the rod assembly 30 from being inextricably locked in its extended position, and the ease of use unlocking the closer—a slight movement of the cover 90 locks the position of the rod assembly 30 with respect to the closer tube 20 and a slight further opening of the door releases the hold open bracket 70 to its neutral position.

The closer tube 20 of the present invention is an open ended hollow tube, typical of the prior art. First end 21 of closer tube 20 receives an end plug assembly 24 that forms an air tight seal with the first end 21 of the closer tube 20. End plug assembly 24 includes a tongue 25 known in the art for attaching the first end 21 of closer tube 20 to a bracket mounted on a door or door jamb. End plug assembly 24 also includes an adjustable valve 28 for regulated the air flow in and out of the closer tube 20 as the rod assembly 30 is extended and retracted into the closer tube 20.

Figure 8A:
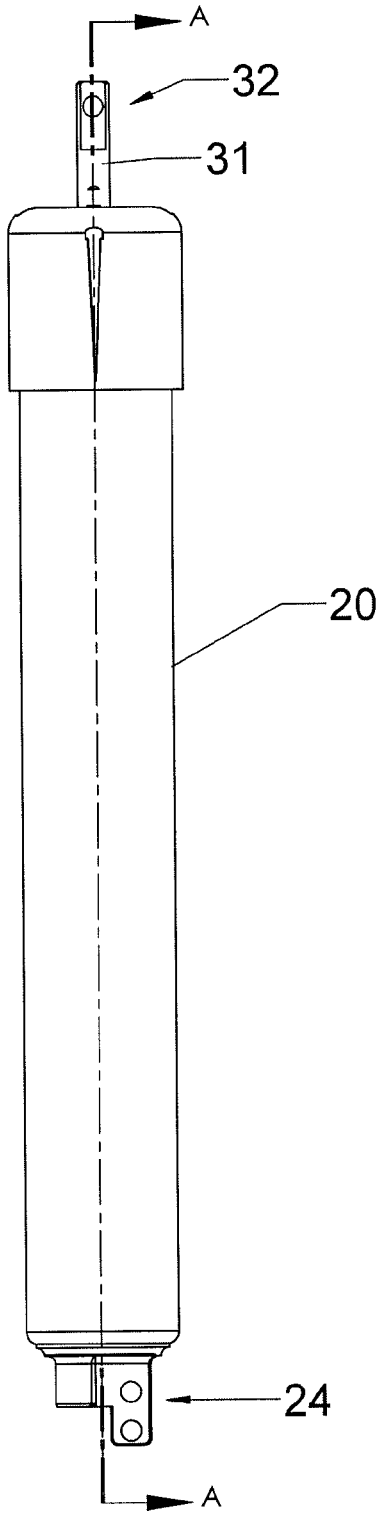
FIG. 8A is a top view of the door cylinder of the present invention with the piston rod retracted.

FIG. 8A discloses a first embodiment of the present invention with the rod 31 retracted into the closer tube 20. The first end 32 of rod 31 remains extended outside the closer tube 20. As shown in the sectional view of FIG. 8B, the rod assembly 30 includes a piston 34 secured to a second end 33 of rod 31 by a pin 35. Mounted to the piston 34 by known means is a seal 37 (typically an "O" ring). The piston 34 is mounted within the closer tube 20 in sliding relation. The piston and seal create an airtight seal with the interior wall of the closer tube 20. As the rod assembly 30 is moved between its extended and retracted positions, air is drawn into and pushed out of the closer tube between the seal 37 and the end plug assembly 24.

Both the first and second ends of rod 31 typically have a smaller diameter than the rest of rod 31 to facilitate securing the piston 34 to the second end 33 of rod 31 and for connecting the first end 32 of rod 31 to a mounting bracket (not shown) mounted on a door or door frame. The first end 32 of rod 31 also typically includes a bore 38 for receiving a fastening pin (not shown) when the first end 32 of rod 31 is secured to the mounting bracket; although other methods of securing the first end 32 of the rod 31 may be utilized.

Figure 8B:
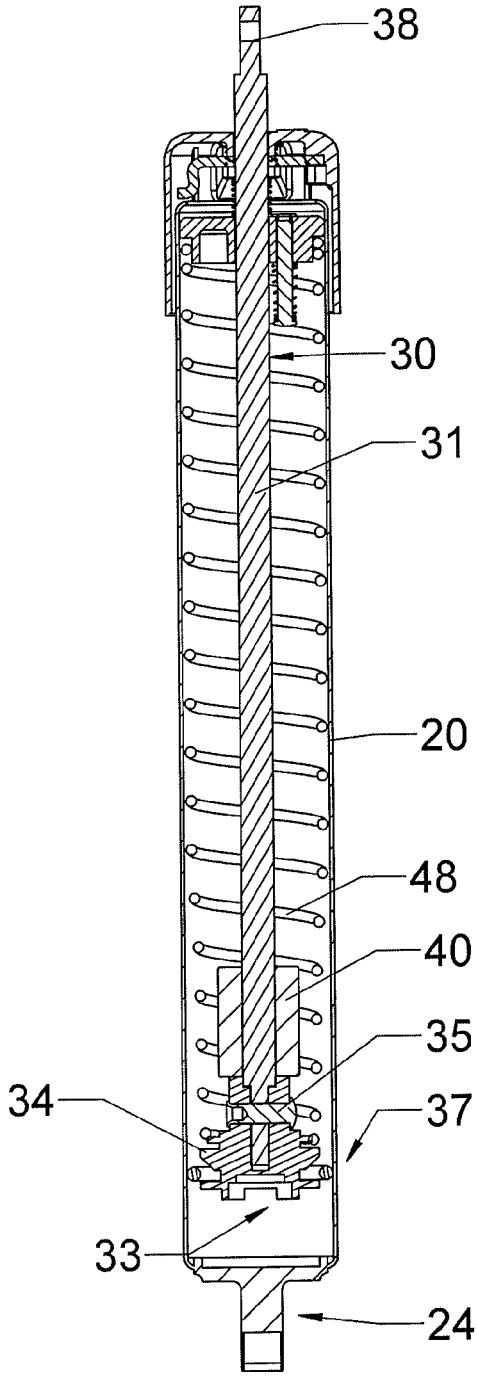
FIG. 8B is a sectional view of the door cylinder of the present invention taken along line A-A of FIG. 8A showing the rod retracted into the door cylinder housing.
Figure 9A:
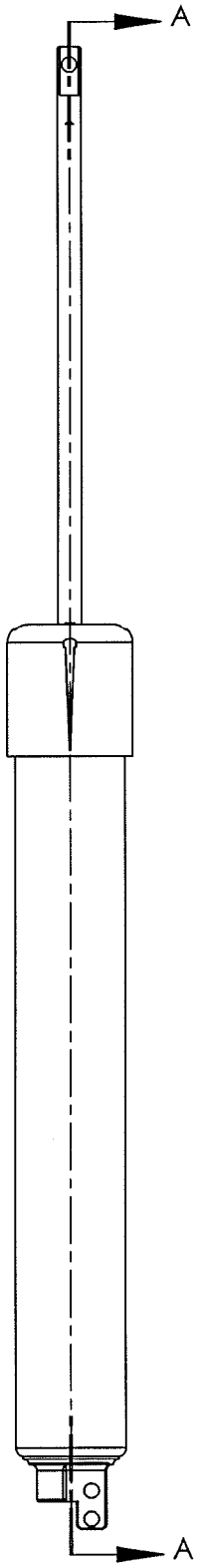
FIG. 9A is a top view of the door cylinder of the present invention with the piston rod extended.
Figure 9B:
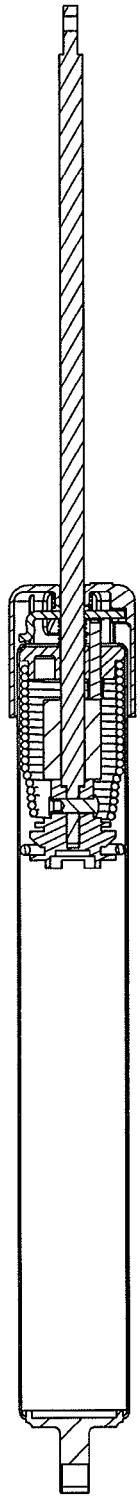
FIG. 9B is a sectional view of the door cylinder of the present invention taken along line A-A of FIG. 9A showing the rod extended from the door cylinder housing.
Figure 10A:
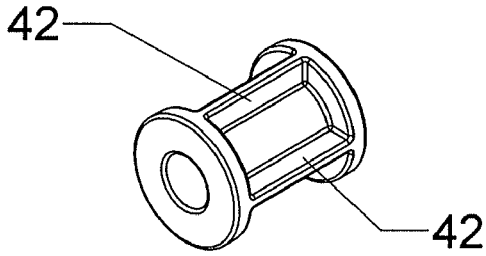
FIG. 10A is a perspective view of a sleeve carried on the rod assembly of the present invention.
Figure 10B:
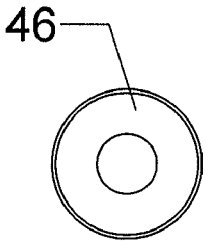
FIG. 10B is an end view of the sleeve carried on the rod assembly of the present invention.
Figure 10C:
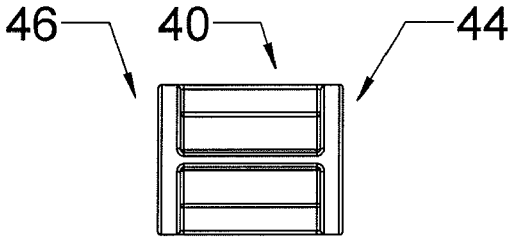
FIG. 10C is a side view of the sleeve carried on the rod assembly of the present invention.
Figure 10D:
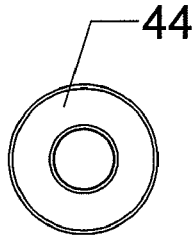
FIG. 10D is an opposite end view of the sleeve carried on the rod assembly of the present invention shown in FIG. 10B.
Figure 10E:
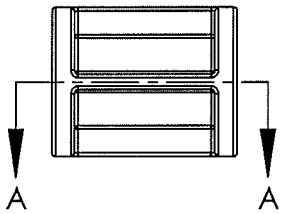
FIG. 10E is a bottom view of the sleeve carried on the rod assembly of the present invention.
Figure 10F:
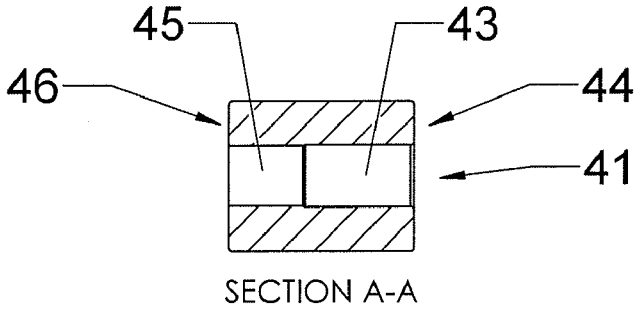
FIG. 10F is a sectional view of the sleeve carried on the rod assembly of the present invention taken along line A-A of FIG. 10E.

In one embodiment, a sleeve 40 is mounted on the rod 31 as shown in FIG. 8B. Sleeve 40 may be slid over the rod 31, it may be fixed to the rod 31 adjacent the piston 34 by pressure fit or other suitable means, or it may be integrally formed as part of the piston.

One embodiment, where the sleeve 40 is pressure fit on rod 31, is shown in FIGS. 10A-10F. In that embodiment, sleeve 40 has an outside diameter smaller than the interior diameter of spring 48 so that the sleeve 40 will not engage or bind with the spring 48. Sleeve 40 is shown as having a number of spaced longitudinal ribs 42 positioned between the first end 44 and the opposing second end 46 of sleeve 40 as shown. A bore 41 extends through the sleeve 40 for receiving the piston rod 31. A first end 43 of the bore 41 at sleeve end 44 has a larger diameter than a second end 45 at sleeve end 46. Bore end 43 is large enough to receive the piston rod 31 in sliding relation. Bore end 45 has a slightly smaller diameter than the outside diameter of rod 31. When mounted on rod 31, sleeve 40 is mounted with sleeve end 44 facing the piston 34. Sleeve 40 is made of selectively resilient material so that as sleeve 40 can be pushed up against piston 34 and the pressure fit formed between the inside wall of bore end 45 and the outer surface of rod 31 will keep sleeve 40 firmly secured to rod 31 adjacent piston 34.

This ribbed embodiment of sleeve 40 produces a lighter more flexible sleeve arrangement; however, other embodiments are possible. For example, sleeve 40 may be integrally formed with the piston 34 or may be a solid rather than ribbed tube. Other embodiments of sleeve 40 are also possible.

Piston spring 48, typically a coil spring, is mounted over the rod 31. The piston spring 48 has an exterior diameter less than the interior diameter of the closer tube 20 and an interior diameter large enough to avoid binding with the sleeve 40.

The rod assembly 30 and rod spring 48 are held within the closer tube 20 by rod end cap 50. As shown in FIGS. 5A-5H, the rod end cap 50 includes a generally circular cover plate 52 (other shapes are possible) defining two tubular openings, a "rod" opening 53 and an optional second "pin" opening 54. Rod 31 extends through rod opening 53 in sliding relation. If desired, a release pin 60, described infra, may be mounted through opening 54 for engagement with the sleeve 40 to prevent the door cylinder 10 from being locked in its fully extended position. Because optional components sleeve 40, pin 60 and bias spring 62 cooperate to prevent the rod 31 from being inextricably locked in its extended position, these components will either be present together or are removed, depending on the desired embodiment of the door closer.

Figure 6A:
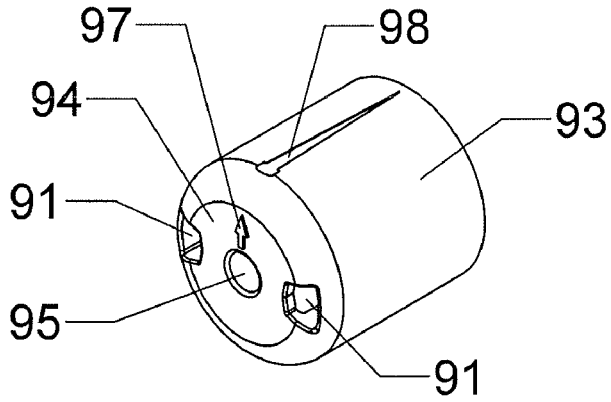
FIG. 6A is a perspective view of a cover of the present invention.

Extending from an outer surface 55 of cover plate 52 is a pair of spaced, opposed "L" shaped locking arms 56. Locking arms 56 are spaced to fit within the interior of cover 90. These locking arms 56 have, at an outer end, engagement fingers 57 designed to engage the cover 90 through opposed openings 91 in cover 90 (FIG. 6A) to secure the cover 90 to the rod end cap 50 in sliding relation. The fingers 57 extend substantially perpendicular from the locking arms 56 towards the center of the rod end cap 50, although other arrangements may be employed.

Figure 5A:
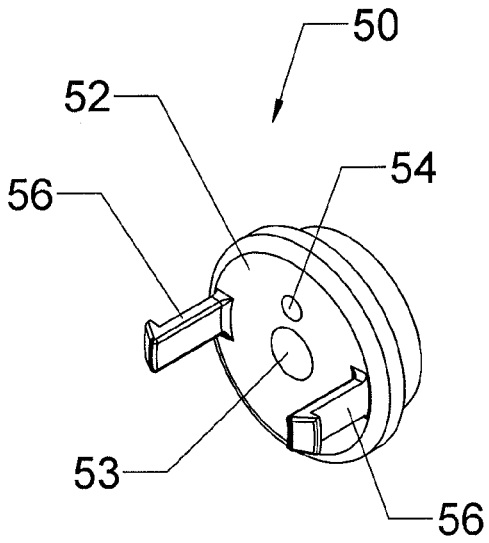
FIG. 5A is a perspective view of the cap of the present invention.
Figure 5B:
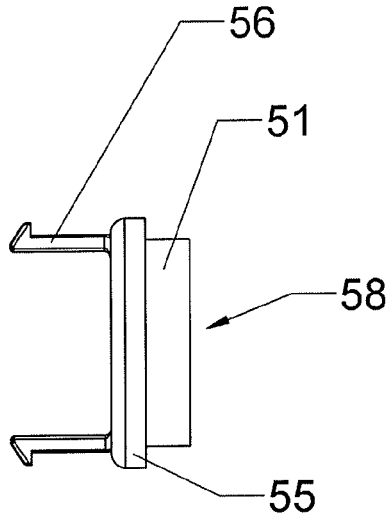
FIG. 5B is a side view of the cap of the present invention.
Figure 5C:
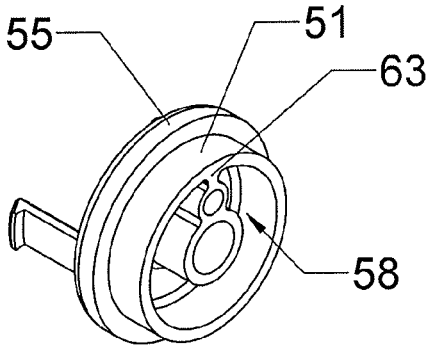
FIG. 5C is a perspective view, opposite that of FIG. 5A, of the cap of the present invention.
Figure 5D:
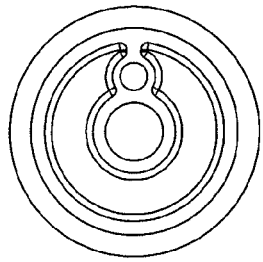
FIG. 5D is an end view of the cap of the present invention taken from the end shown in FIG. 5C.
Figure 5E:
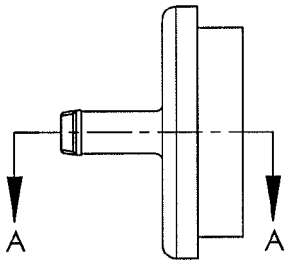
FIG. 5E is a side view of the cap of the present invention.
Figure 5F:
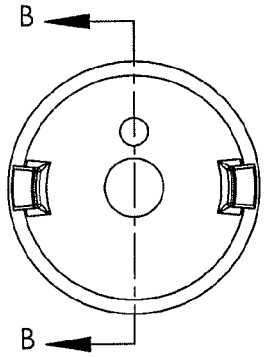
FIG. 5F is an end view of the cap of the present invention taken from the end shown in FIG. 5A.
Figure 5G:
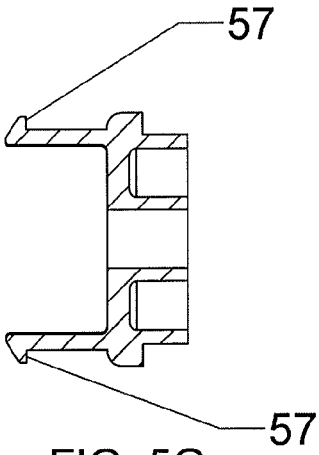
FIG. 5G is a sectional view of the cap of the present invention taken along the line A-A of FIG. 5E.
Figure 5H:
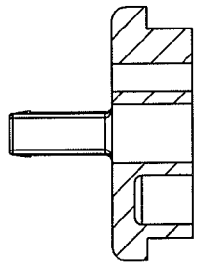
FIG. 5H is a sectional view of the cap of the present invention taken along the line B-B of FIG. 5F.
Figure 11:
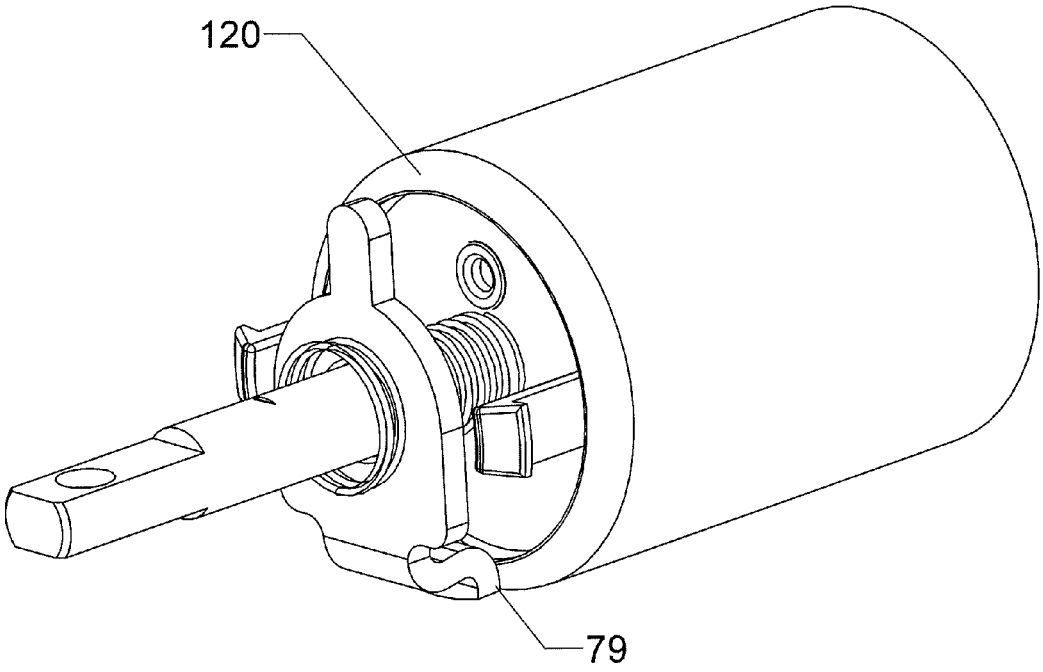
FIG. 11 is a perspective view of one end of the door cylinder with the cover removed to illustrate the engagement of the hold open bracket and the closer tube.

Rod assembly 30 is mounted within closer tube 20 in sliding relation. End cap 50 is then mounted to the open second end 22 of closer tube 20. Referring to FIG. 5B, cover 52 of end cap 50 defines an outer rim 55. Extending from the cover 52 in an opposite direction of arms 56 is a tubular sleeve 51. The tubular sleeve 51 has a diameter sized to slide into an end of the piston spring 48. The outer rim 55 has an outside diameter slightly smaller than inside diameter of the tubular sleeve 51 so that the entire rod end cap 50 can slide into the closer tube 20 to generally close the second end 22 of the closer tube 20. An outer edge 120 of closer tube 20 is swaged or formed over the rod end cap 50 as shown in FIG. 11 to secure the rod end cap 50 within the closer tube 20. When so assembled, rod end cap 50 cannot be removed from the closer tube 20 and is biased against the second end 22 of closer tube 20 by spring 48. Further, the first end 32 of rod 31 slidably extends through opening 53 of rod end cap 50.

Figure 7A:
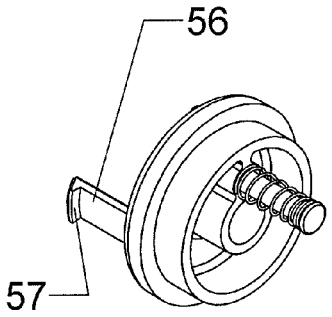
FIG. 7A is a perspective view of an alternate embodiment of the rod end cap of the present invention with a spring pin mounted on the cover.
Figure 7F:
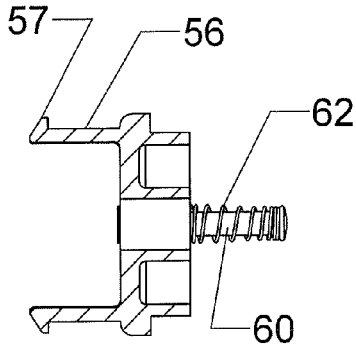
FIG. 7F is a sectional view of the cap of the present invention taken along line A-A in FIG. 7D.
Figure 7G:
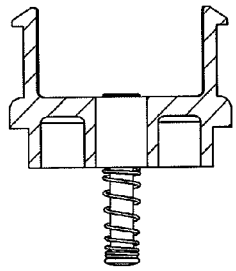
FIG. 7G is a sectional view of the cap of the present invention taken along line B-B in FIG. 7C.
Figure 7B:
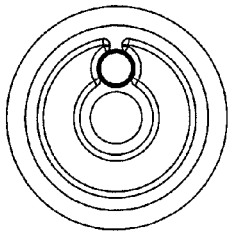
FIG. 7B is a front view of the cap of the present invention taken from FIG. 7A.
Figure 7D:
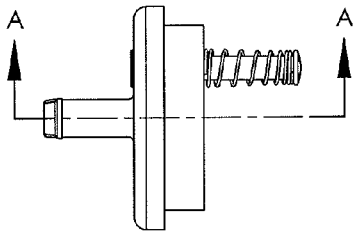
FIG. 7D is a side view of the cap of the present invention.
Figure 7C:
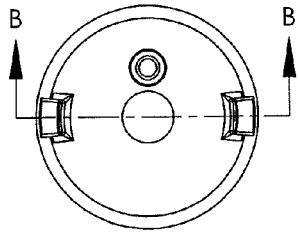
FIG. 7C is a back view of the cap of the present invention taken opposite that of FIG. 5B.
Figure 7E:
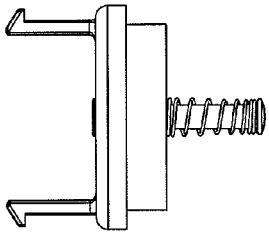
FIG. 7E is a side view of the cap of the present invention rotated 90 degrees from FIG. 7D.
Figure 7H:
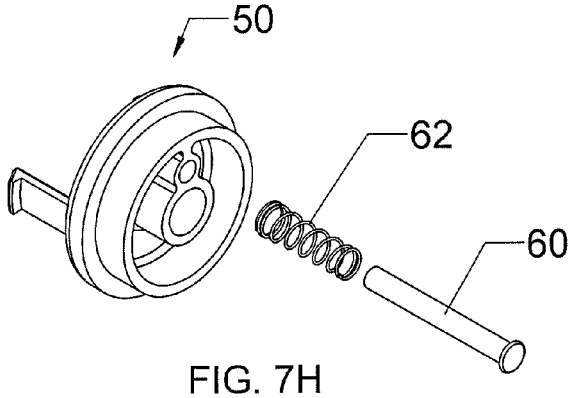
FIG. 7H is an exploded view of the cap of the present invention showing the pin and spring before being mounted to the cap.

In another embodiment, where release pin 60, bias spring 62, and sleeve 40 are utilized, release pin 60 is mounted within pin opening 54 of rod end cap 50 in sliding relation as shown in FIGS. 7A-7H. Release pin 60 is typically a rivet or small bolt of greater length than the tubular opening 54. Mounted on release pin 60 is a bias spring 62, typically a coil spring. Release pin 60 and release spring 62 are mounted to the rod end cap 50 as shown in FIG. 7E with the release pin biased by the spring 62 to normally extend from the interior surface 63 of rod end cap 50. Release pin 60 is mounted so that it can not be removed from rod end cap 50.

When rod end cap 50 is mounted to the second end 22 of closer tube 20, the release pin 60 will extend into the closer tube 20 to contact sleeve 40 upon extension of rod 31 from the closer tube 20. Extension of rod 31 causes the piston 34 to be drawn towards the second end 22 of closer tube 20. This in turn draws the sleeve 40 towards the release pin 60. When an end 46 of sleeve 40 engages the release pin 60, it overcomes the bias of spring 62 and slides the release pin 60 partially through pin opening 54 so that a portion of release pin 60 extends outward from the outer surface 52 of rod end cap 50 into engagement with the hold open bracket 70, causing the hold open bracket 70 to move to its neutral position. This prevents the rod assembly 30 from being locked in an extended position and is particularly helpful for releasing the closer when locked in its fully extended position.

In all embodiments, mounted over rod 31, between rod end cap 50 and cover 90, is first bracket spring 80, the hold open bracket 70 and a second bracket spring 82, as shown in FIG. 3. Bracket springs 80 and 82 maintain the hold open bracket in a neutral position, allowing the rod 31 to be freely extended from and retracted into the closer tube 20 and provide superior results to a single spring as shown in the prior art. The rod 31 is moved between its extended and retracted positions constantly as the door is opened and closed. A single spring would help keep the hold open bracket 70 in a neutral position when the rod 31 is moved in a direction from the bracket to the spring, but not in the reverse direction, since friction between the hold open bracket 70 and rod 31 would tend to draw the bracket away from the spring, rendering the spring ineffective. Applicant's invention overcomes this shortcoming in the prior art.

Bracket springs 80 and 82 are typically coil springs and may have similar or dissimilar diameters, lengths and compression strength. In one preferred embodiment, bracket spring 80 will have a longer length and smaller diameter than bracket spring 82 to help control the point at which the release pin 60 engages the hold open bracket 70, and to better assist the cover 90, when moved into engagement with the hold open bracket 70, to set the hold open bracket 70 in its locked position. Spring 82 is shown in FIGS. 3 and 11 as having a smaller diameter than spring 82 so that it does not interfere with the operation of the release pin 60.

A first embodiment of the hold open bracket 70 is disclosed in FIGS. 4A-4E and includes washer shaped body 72 defining a rod opening 74 for engaging the rod 31 in sliding relation, an actuator arm 76 and a cylinder engagement tab 78. The hold open bracket 70 is mounted with the cylinder engagement tab 78 extended towards the second end 22 of the closer tube 20. The length of the hold open bracket 70 is shorter than the inside diameter of cover 90 so as not to interfere with the operation of cover 90.

The actuator arm 76 extends laterally outward from the washer body 72 to engage an actuator or saddle 92 (FIG. 6B) formed by or carried by the cover 90. When the cover 90 is slid towards the rod end cap 50, the actuator 92 will engage the actuator arm 76 of hold open bracket 70 and re-orient the hold open bracket 70 so that it is no longer in its neutral position, substantially perpendicular to the rod 31, but is oriented at an angle with respect to rod 31 with the engagement tab 78 operatively engaged with the second end 22 of the closer tube 20 to create a binding relationship between the rod 31, hold open bracket 70 and the closer tube 20 to fix the position of the rod assembly 30 with respect to the closer tube 20. Engagement tab 78 includes a curved tail 79 extending generally parallel to and away from the washer body 72. When the hold open bracket is tipped at an angle with respect to the rod 31, the tail 79 engages the swaged edge 120 of closer tube 20, at the second end 22 of the closer tube 20, to fix the position of the rod 31 with respect to the closer tube 20. This results in the door being maintained in a desired open position.

As shown in FIGS. 6A-6H, the cover 90 includes a tubular body 93 closed at end one end 94, a rod opening 95 defined in the closed end 94 to permit passage of the first end 32 on rod 31 there through, and a pair of spaced, opposed lock arm finger openings 91 for receiving the engagement fingers 57 of locking arms 56 of rod end cap 50. A direction or orientation arrow 97 is formed or placed on the closed end 94 of cover 90. A second direction arrow 98 is defined on tubular side of the cover 90, in alignment with arrow 97 on the closed end of cover 90 to provide guidance for proper alignment of the cover to the rod end cap 50 which facilitates proper alignment of the cover actuator 92 with the actuator arm 76 of the hold open bracket 70.

Openings 91 have a slightly smaller diameter than the length of the rod end cap locking arm fingers 57 so that the fingers 57 must be bent slightly in order for the fingers to be inserted through the openings 91. At least the fingers 57 of the rod end cap are made of resilient material to permit the fingers 57 to return to their original position once inserted through the cover openings 91. Adjacent to the openings 91 are recessed platforms or lips 99 which engage the fingers 57 to prevent the fingers from being retracted from the cover 90. However, the openings 91 are of sufficient size to permit the locking arms 56 to slide through the openings, so that the cover 90 can be moved along the axis of rod 30 towards the rod end cap 50, to permit engagement of the cover actuator 92 with the actuator arm 76 of the hold open bracket 70.

Figure 6B:
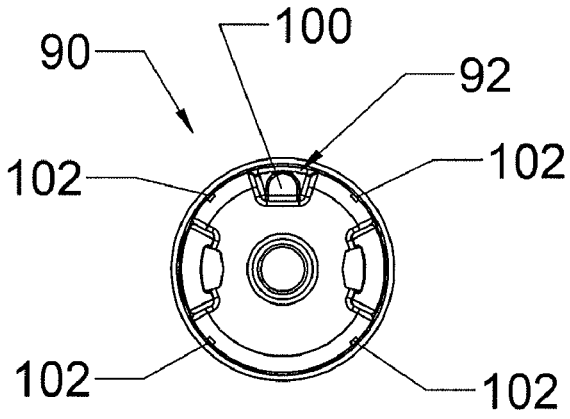
FIG. 6B is an end view of the open end of the cover of the present invention.
Figure 6C:
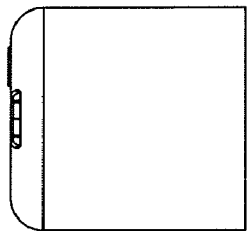
FIG. 6C is a side view of the cover of the present invention.
Figure 6H:
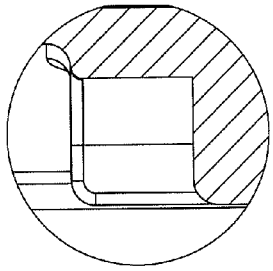
FIG. 6H is a detailed view of area "D" of the cover of the present invention as shown in FIG. 6E.
Figure 6D:
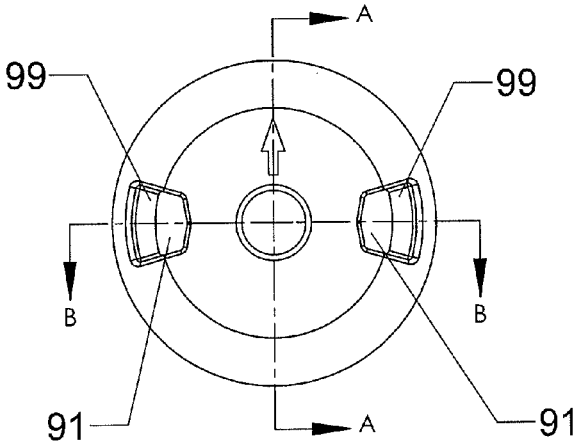
FIG. 6D is an end view of the closed end of the cover of the present invention.
Figure 6E:
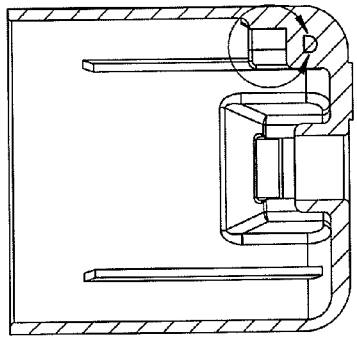
FIG. 6E is a sectional view of the cover of the present invention taken along line A-A of FIG. 6D.
Figure 6F:
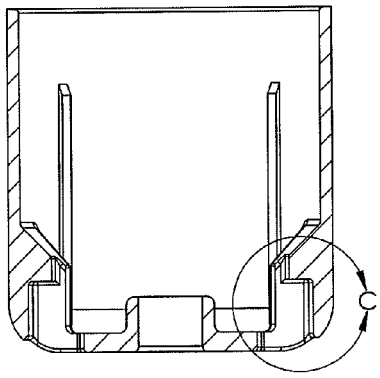
FIG. 6F is a sectional view of the cover of the present invention taken along line B-B of FIG. 6D.
Figure 6G:
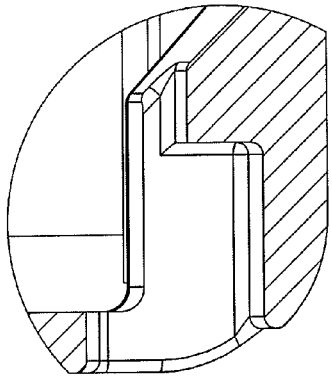
FIG. 6G is a detailed view of area "C" of the cover of the present invention as shown in FIG. 6F.

On the inside of the cover, shown in FIG. 6B, is the actuator 92. Actuator 92 is a raised portion or a protrusion formed or constructed on the inside of the cover 90. The protrusion includes a recess 100 that is sized and shaped to receive and engage the actuator arm 76 of hold open bracket 70. The actuator 76 is easily aligned with the actuator arm 76 of the hold open bracket 70 by use of the alignment arrows, to assure that the hold open bracket actuation arm 76 is aligned with cover actuator 92.

The hold open bracket 70 is compact and does not extend beyond the interior of the cover 90. The hold open bracket 70 is held in continuous contact with the cover actuator 92 in recess 100 by hold open bracket springs 80 and 82, whether the cover 90 is in its neutral position, biased at its furthest distance from the rod end cap 50, or in its actuated position, pressed against the rod end cap 50 to engage the hold open bracket and move it to the locked position.

When actuated, the cylinder engagement tab 78 of hold open bracket 70 is directly moved into engagement with the closer tube 20, immediately locking the position of the rod assembly 30 with respect to the closer tube 20. There is minimal retraction of the rod assembly 30 back into the closer tube 20 following engagement of the hold open bracket 70 so the door can be easily set at its desired degree of door width the first time the hold open bracket 70 is engaged. Further, the door may be locked in its fully opened position and does not suffer the back swing suffered by many prior art door closers which rely on some retraction of the rod assembly into the closer tube to fully engage the hold open bracket.

Cover 90 also includes ribs 102 which are small protrusions, generally parallel to each other, that run the length of the sides of the cover. These ribs are intended to engage the outside of the closer tube 20 and limit the surface of the interior of the cover 90 that engages the closer tube 20. Closer tube 20 can be painted for aesthetic and functional reasons. The ribs 102 prevent excessive wear and tear on the paint, which wear and tear could adversely impact the look and function of the closer tube 20.

What is claimed is:

1. A door cylinder comprising:

(a) a tubular housing closed at a first end;

(b) a rod having a piston at a first end and bracket engaging means at a second end, slidably mounted within the housing for movement from an extended to a retracted position;

(c) a piston spring mounted over the rod for biasing the rod within the housing in a retracted position;

(d) a rod end cap including a rod guide mounted within the open end of the housing with the rod slidably extended through the rod guide;

(e) a hold open bracket slidably mounted on the rod for movement between a neutral and engaged position for releasably securing the position of the rod with respect to the housing;

(f) a pair of bracket springs slidably mounted on the rod on opposite sides of the hold open bracket for biasing the hold open bracket in its neutral position to permit movement of the rod with respect to the housing;

(g) a cover slidably mounted over the rod end cap including means for directly engaging the hold open bracket to cause the hold open bracket to move to the engaged position;

(h) a sleeve positioned on the rod adjacent the piston;

(i) a release pin slidably mounted on the rod end cap for movement between a neutral position extending into the tubular housing from the rod end cap and a released position partially extended outward from the rod end cap; and (j) a release pin bias means for biasing the release pin in its neutral position;

wherein upon movement of the piston to its extended position, the sleeve will be drawn into engagement with the release pin, causing the release pin to slide into engagement with the hold open bracket to prevent the hold open bracket from being moved to or maintained in its engaged position when the rod is fully extended.

2. The door cylinder of claim 1 wherein one bracket spring has a different diameter, length or compression strength than the other bracket spring.

3. The door cylinder of claim 1 wherein the hold open bracket includes a tongue and a cylinder engagement tab and the means for directly engaging the hold open bracket includes a projection from an interior surface of the cover aligned to engage the hold open bracket tongue.

4. The door cylinder of claim 1 wherein the sleeve is pressure fit over the rod adjacent the piston.

5. The door cylinder of claim 1 wherein the sleeve is integrally formed with the piston.

6. The door cylinder of claim 1 wherein the cover includes a closed end and the means for directly engaging the hold open bracket is a projection extending from the inside of the closed end of the cover.

7. The door cylinder of claim 1 wherein the cover includes a closed end and the means for directly engaging the hold open bracket is a saddle formed at the outer end of a projection extending from the inside of the closed end of the cover.

8. The door cylinder of claim 1 further comprising one or more direction indicators defined on the cover for aligning the means for directly engaging the hold open bracket with the hold open bracket.

9. The door cylinder of claim 1 wherein: (a) the rod end cap includes a pair of opposed locking arms extending from an exterior surface of the rod end cap; (b) the cover includes a pair of openings for receiving the rod end cap locking arms to permit the cover to be slidably moved towards and away from the rod end cap.

10. The door cylinder of claim 1 wherein the hold open bracket includes a tail member for engaging the closer tube upon movement of the hold open bracket from its neutral position to its engaged position.

11. The door cylinder of claim 1 wherein the piston creates an airtight seal with the inner wall of the housing.

12. The door cylinder of claim 1 wherein the housing is a tube with open longitudinal ends and the first end of the housing is closed by an end plug having an adjustable valve to regulate the rate of air entering and escaping from the housing.

13. The door cylinder of claim 9 wherein the end plug further includes means for engaging a support bracket.

14. The door cylinder of claim 1 wherein the rod end cap is mounted within a second end of the tubular housing and is retained in place by swaging an outer edge of the second end of the tubular housing inward to form an opening too small for the end cap to be removed.

15. The door cylinder of claim 1 wherein the rod end cap is mounted within a second end of the tubular housing and is retained in place by swaging an outer edge of the second end of the tubular housing inward to form an opening too small for the end cap to be removed, and the hold open bracket engages the swaged portion of the closer tube when in its engaged position.

16. The door cylinder of claim 1 wherein the rod end cap includes means for engaging a first end of the piston spring and the rod piston includes means for engaging a second end of the piston spring.

17. The door cylinder of claim 16 wherein the means for engaging a first end of the piston spring is an outer edge of the rod end cap.

18. The door cylinder of claim 1 wherein the hold open bracket is sized to fit entirely within the interior diameter of the cover.

* * * * *